US008641163B2

(12) United States Patent
Williams et al.

(10) Patent No.: US 8,641,163 B2
(45) Date of Patent: Feb. 4, 2014

(54) TEMPERATURE LEVELING ROLLER AND PRESSURE NIP ASSEMBLY

(75) Inventors: James Edward Williams, Penfield, NY (US); Paul John McConville, Webster, NY (US); Jeffrey J. Folkins, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 1060 days.

(21) Appl. No.: 12/617,255

(22) Filed: Nov. 12, 2009

(65) Prior Publication Data

US 2011/0109683 A1 May 12, 2011

(51) Int. Cl.
*B41J 29/38* (2006.01)
*B41J 2/01* (2006.01)

(52) U.S. Cl.
USPC ..... 347/17; 347/16; 347/102

(58) Field of Classification Search
USPC ..... 347/17
See application file for complete search history.

(56) References Cited

U.S. PATENT DOCUMENTS 6,494,570 B1 * 12/2002 Snyder ..... 347/103
2008/0017062 A1 1/2008 Seyfried
2008/0248196 A1 10/2008 Anderson et al.
2009/0141110 A1 6/2009 Gervasi et al.
2009/0160920 A1 6/2009 Badesha et al.

* cited by examiner

*Primary Examiner* — Uyen Chau N Le
*Assistant Examiner* — Kajli Prince
(74) *Attorney, Agent, or Firm* — Maginot, Moore & Beck, LLP

(57) ABSTRACT

An imaging device includes a substantially continuous web of media, and a web transport system configured to transport the continuous web along a web path. A print station is positioned along the web path and is configured to apply ink to the continuous web. A temperature leveling ink spreader is disposed along the web path downstream from the print station. The temperature leveling ink spreader includes a leveler roller including a heater configured to generate thermal energy to heat the leveler roller to a spreading temperature. The leveler roller is positioned to be partially wrapped by the continuous web to generate a predetermined dwell time between the continuous web and the leveler roller as the continuous web is being transported to equalize the temperatures of the web and ink on the web to within a predetermined range about the spreading temperature. The temperature leveling ink spreader includes a pressure roller positioned adjacent the leveler roller to form a spreading nip therebetween through which the continuous web is fed after the predetermined dwell time. The spreading nip is configured to apply a predetermined pressure to the continuous web and the ink thereon.

18 Claims, 3 Drawing Sheets

TEMPERATURE LEVELING ROLLER AND PRESSURE NIP ASSEMBLY

TECHNICAL FIELD

The present disclosure relates to imaging devices that deposit marking material onto a substantially continuous web, and, in particular, to fixing assemblies for fixing the marking material to the web in such devices.

BACKGROUND

In general, ink jet printing machines or printers include at least one printhead that ejects drops or jets of liquid ink onto a recording or image forming media. A phase change ink jet printer employs phase change inks that are in the solid phase at ambient temperature, but transition to a liquid phase at an elevated temperature. The molten ink can then be ejected onto a printing media by a printhead directly onto an image receiving substrate, or indirectly onto an intermediate imaging member before the image is transferred to an image receiving substrate. Once the ejected ink is on the image receiving substrate, the ink droplets quickly solidify to form an image.

In both the direct and offset printing architecture, images may be formed on a continuous media web. In a web printer, a continuous supply of media, typically provided in a media roll, is conveyed by a plurality of rollers that are arranged to guide the media web through a print zone where a plurality of printheads are positioned to deposit ink onto the web to form images. Beyond the print zone, the media web is gripped and pulled by mechanical structures so a portion of the media web continuously moves through the print zone. Tension bars or rollers may be placed in the feed path of the moving web to remove slack from the web so it remains taut without breaking.

In continuous-web direct to paper printing, a fixing assembly is used after the ink is jetted onto the web to fix the ink to the web. The fixing assembly used depends on the type of ink. For example, when using melted phase change ink to form images, the fixing assembly may include a pair of rollers that defines a nip therebetween for applying pressure to the ink and web to spread the ink on the web. The function of the pair of rollers, also referred to herein as a spreader, is to transform a pattern of ink droplets deposited onto a web and spread them out to make a more uniform and continuous layer. The spreader uses pressure and/or heat to reduce the height of the ink droplets and fill the spaces between adjacent drops.

One difficulty faced in the operation of the spreader is providing the web and the ink deposited thereon to the spreader at a temperature that enables the ink deposited on the web to be spread uniformly in order to achieve a desired image quality. Due to the very fast processing speeds that may be capable of being performed by some continuous feed imaging device, the ink deposited on the web at the print station may be too hot when it reaches the spreader resulting in the ink bleeding into the web farther than desired and possibly showing through on the other side. Conversely, if for some reason the ink cools down too much prior to reaching the spreader, the ink may not be malleable enough to allow for sufficient line spread as well as adherence to the web. In addition, the ink jetted by the printheads is generally much hotter than the paper temperatures, and, consequently, imaged areas with high ink coverage may exit from the print zone at higher temperatures than the inked areas of sparse halftones where the ink temperature is dominated by the temperature and heat capacity of the paper. Consequently, the ink deposited on the web may be at a wide range of temperatures when the web reaches the spreader depending on the number of layers or piles of ink at a particular location on the web. Ink that enters the spreader at varying temperatures may cause inconsistent and non-uniform line spread on the web.

Thus, one objective in the operation of the imaging device is to bring the temperatures of the paper and ink layers to be approximately equal and to be somewhere in the same range as the operating temperature of the spreader prior to entering the spreader nip. In some previously known continuous feed direct to paper printing processes, a temperature leveling roller was added prior to the spreader to cause the ink and web temperatures to be approximately the same or within a desired range of each other. The leveling roller typically operated at an intermediate temperature that was lower than the desired spreading temperature in order to equalize the ink and web temperatures. The leveling roller cooled the high piles of ink. The ink then needed to be heated prior to entering the spreader. Therefore, in some previously known systems, a heater was added that typically used radiant heat to reheat the ink and media to the desired spreading temperature prior to reaching the spreader. While such a process may be effective in equalizing the temperatures and bringing them to the desired spreading temperature for optimal spreading, the use of separate devices for temperature leveling, reheating, and spreading that each require individual temperature control increases the complexity and cost of producing an imaging device as well as increase the overall footprint of the device. In addition, radiant heaters, because they typically have to operate at high temperatures relative to the target web and ink temperature, may require complicated devices or methods to prevent web overheating when the web stops or breaks.

SUMMARY

A system for use with an imaging device has been developed that enables the equalization of the marking material and web temperatures to within a predetermined range of a target temperature that does not require a two stage heating of the web or the use of radiant heaters to heat the web and ink thereon to the target temperature. In one embodiment, such an imaging device comprises a substantially continuous web of media and a web transport system configured to transport the continuous web along a web path in a process direction at a web speed. A marking system is positioned along the web path and configured to apply a marking material to the continuous web to form images thereon. The imaging device is provided with a leveler roller formed of a thermally conductive material and including a heater configured to generate thermal energy to heat the leveler roller to a target temperature. The leveler roller is positioned to be partially wrapped by the continuous web to define a wrap length. The wrap length being predetermined based on the web speed to generate a dwell time between the continuous web and the leveler roller as the continuous web is being transported. Conductive heat transfer occurs between the continuous web and the leveler roller during the dwell time that equalizes a temperature of the continuous web and temperatures of the marking material on the web to within a target range about the target temperature. A pressure roller is positioned adjacent the leveler roller to form a pressure nip therebetween through which the continuous web is fed after the predetermined dwell time. The pressure nip applies a target pressure to the continuous web and the marking material thereon as they move through the pressure nip.

In another embodiment, a method of operating a continuous feed imaging device is provided. The method includes transporting a substantially continuous web of media along a web path, and depositing marking material onto the continuous web at a marking station positioned along the web path. The continuous web is then wrapped partially around a leveler roller after the deposition of the marking material to generate a dwell time between the continuous web and the leveler roller. The leveler roller is heated to a target temperature. The dwell time is configured to enable conductive heat transfer to occur between the continuous web and the leveler roller to heat the continuous web and the marking material on the continuous web to the target temperature. After the dwell time, the web is fed through a pressure nip formed by the leveler roller and a pressure roller arranged adjacent the leveler roller. The pressure nip is configured to apply a target pressure to the continuous web and the marking material thereon.

DETAILED DESCRIPTION

Figure 1:
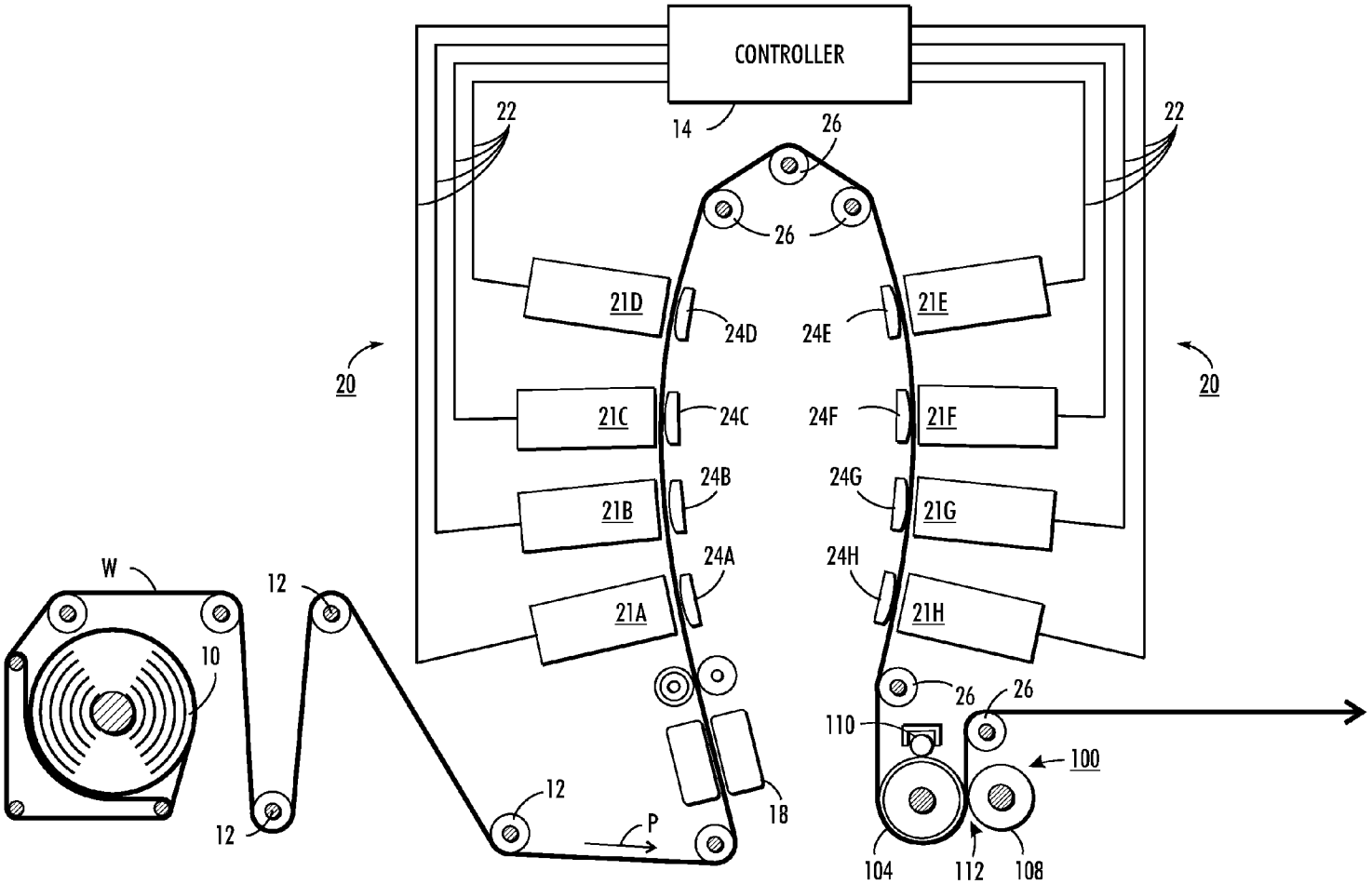
FIG. 1 is a simplified elevational view of a direct-to-media, continuous-web, phase-change ink printer.

For a general understanding of the present embodiments, reference is made to the drawings. In the drawings, like reference numerals have been used throughout to designate like elements.

As used herein, the term "imaging device" generally refers to a device for applying an image to print media. "Print media" may be a physical sheet of paper, plastic, or other suitable physical print media substrate for images, whether precut or continuous web fed. The imaging device may include a variety of other components, such as finishers, paper feeders, and the like, and may be embodied as a copier, printer, or a multifunction machine. A "print job" or "document" is normally a set of related sheets, usually one or more collated copy sets copied from a set of original print job sheets or electronic document page images, from a particular user, or otherwise related. An image generally may include information in electronic form which is to be rendered on the print media by the marking engine and may include text, graphics, pictures, and the like. As used herein, the process direction is the direction in which an image receiving surface, e.g., media sheet or web, or intermediate transfer drum or belt, onto which the image is transferred moves through the imaging device. The cross-process direction, along the same plane as the image receiving surface, is substantially perpendicular to the process direction.

FIG. 1 is a simplified elevational view of a direct-to-media, continuous-web, phase-change ink printer. A web supply and handling system is configured to supply a very long (i.e., substantially continuous) web W of "substrate" (paper, plastic, or other printable material) from a spool 10. The web W may be unwound as needed, and propelled by a variety of motors, not shown. The web supply and handling system is capable of transporting the web W at a plurality of different speeds. A set of rolls 12 controls the tension of the unwinding web as the web moves through a path.

Along the path there is provided at least one preheater 18, which brings the web to an initial predetermined temperature. The preheater 18 can rely on contact, radiant, conductive, or convective heat to bring the web W to a target preheat temperature, which in one practical embodiment, is in a range of about 30° C. to about 70° C.

The web W is transported through a marking station 20 that is configured to deposit a marking material onto the web to form images. In the embodiment of FIG. 1, the marking station includes a series of printheads 21A-21H, each printhead effectively extending across the width of the web and being able to place ink of one primary color directly (i.e., without use of an intermediate or offset member) onto the moving web. Eight printheads are shown in FIG. 1 although more or fewer printheads may be used. As is generally familiar, each of the four primary-color images placed on overlapping areas on the web W combine to form color images, based on the image data sent to each printhead through image path 22 from print controller 14. In various possible embodiments, there may be provided multiple printheads for each primary color; the printheads can each be formed into a single linear array. The function of each color printhead can be divided among multiple distinct printheads located at different locations along the process direction; or the printheads or portions thereof can be mounted movably in a direction transverse to the process direction P, such as for spot-color applications.

In one embodiment, the marking material applied to the web is a "phase-change ink," by which is meant that the ink is substantially solid at room temperature and substantially liquid when heated and initially jetted onto the web 14. Currently-common phase-change inks are typically heated to about 80° C. to 140° C., and thus in liquid phase, upon being jetted onto the web W. Generally speaking, the liquid ink cools down quickly upon hitting the web W. In alternative embodiments, however, any suitable marking material or ink may be used including, for example, ultraviolet (UV) curable ink, or aqueous ink.

Each printhead may have a backing member 24A-24H, typically in the form of a bar or roll, which is arranged substantially opposite the printhead on the other side of web W. Each backing member is used to position the web W so that the gap between the printhead and the sheet stays at a known, constant distance. Each backing member can be controlled to cause the adjacent portion of the web to reach a predetermined "ink-receiving" temperature, in one practical embodiment, of about 30° C. to about 70° C. In various possible embodiments, each backing member can include heating elements, cavities for the flow of liquids therethrough, etc.; alternatively, the "member" can be in the form of a flow of air or other gas against or near a portion of the web W. The combined actions of preheater 18 plus backing members 24 held to a particular target temperature effectively maintains the web W in the printing zone 20 in a predetermined temperature range of about 30° C. to 70° C.

As the partially-imaged web moves to receive inks of various colors throughout the printing station 20, the temperature of the web is maintained within a given range. Ink is jetted at a temperature typically significantly higher than the receiving web's temperature which heats the surrounding paper (or whatever substance the web W is made of). Therefore the members in contact with or near the web in zone 20 must be adjusted so that that the desired web temperature is maintained. For example, although the backing members may have an effect on the web temperature, the air temperature and air flow rate behind and in front of the web may also impact the web temperature. Accordingly, air blowers or fans may be utilized to facilitate control of the web temperature.

The web temperature is kept substantially uniform for the jetting of all inks from printheads in the printing zone 20. This uniformity is valuable for maintaining image quality, and particularly valuable for maintaining constant ink lateral spread (i.e., across the width of web W, such as perpendicular to process direction P) and constant ink penetration of the web. Depending on the thermal properties of the particular inks and the web, this web temperature uniformity may be achieved by preheating the web and using uncontrolled backer members, and/or by controlling the different backer members 24A-24H to different temperatures to keep the substrate temperature substantially constant throughout the printing station. Temperature sensors (not shown) associated with the web W may be used with a control system to achieve this purpose, as well as systems for measuring or inferring (from the image data, for example) how much ink of a given primary color from a printhead is being applied to the web W at a given time. The various backer members can be controlled individually, using input data from the printhead adjacent thereto, as well as from other printheads in the printing station.

Figure 2:
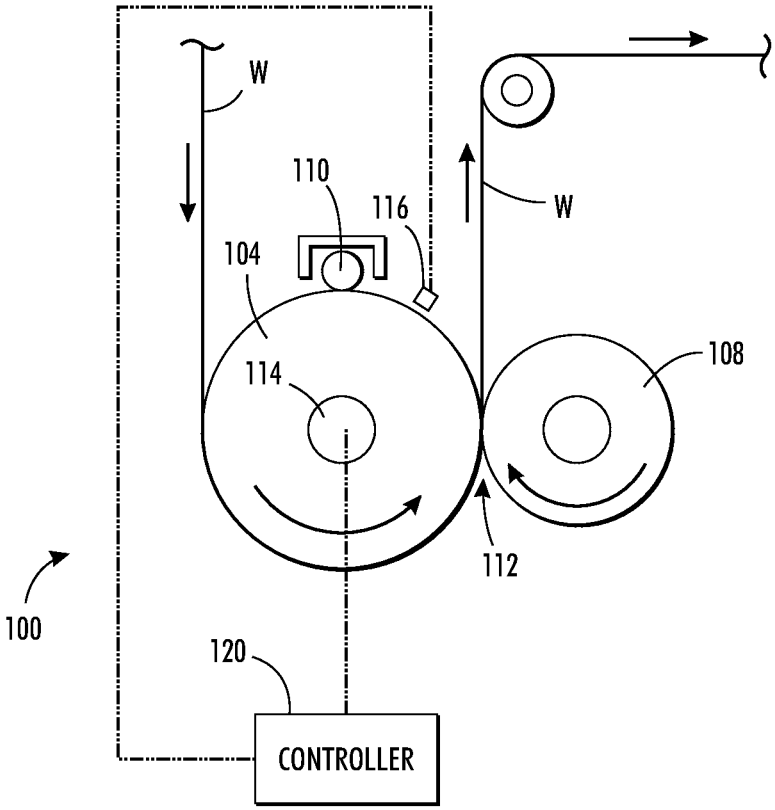
FIG. 2 is a schematic view of an embodiment of temperature leveling ink spreading system for use with the imaging device of FIG. 1.

Following the printing zone 20, along the path of web W, is a leveling roller and pressure nip assembly 100. With reference to FIG. 2 and continuing reference to FIG. 1, the leveling roller and pressure nip assembly 100 includes a temperature controlled leveling roller 104 and a pressure roller 108 that are arranged with respect to each other to define a spreading nip 110 through which the web W is fed. The spreading nip 110 is configured to apply pressure to the web and the ink on the web to take what are essentially isolated droplets of ink on web W and spread them so that spaces between adjacent drops are filled and image solids become uniform. In addition to spreading the ink, the spreading nip 110 may also improve image permanence by increasing ink layer cohesion and/or increasing the ink-web adhesion. The pressure at the spreading nip 110 between the leveling roller and pressure roller may be any suitable pressure that enables ink drop or line spreading on the web to achieve desired image quality. Factors to consider in the selection of the spreading nip pressure include the fact that lower nip pressures may give less line spread while higher pressures may reduce pressure roll life. In one practical embodiment, the nip pressure at the spreading nip 110 is set in a range of about 500 psi to about 2000 psi although any suitable spreading nip pressure may be utilized.

For optimum spreader performance, ink and web temperatures should be substantially uniform prior to entering the spreading nip 110 and be at a target temperature or within a target temperature range that promotes adherence of the melted ink to the web, minimizes "show through" of the ink through the web, and maximizes ink dot spread. The target temperature and the target temperature range for the ink and web temperatures prior to entering the spreading nip 110 may also be referred to as the spreading temperature or spreading temperature range (explained below). In addition, the process of bringing the ink and web temperatures to the spreading temperature or spreading temperature range may also be referred to as equalization of the ink and web temperatures. In one embodiment, the spreading temperature may be any temperature between approximately 30° C. and approximately 80° C., and, in one particular embodiment, is approximately 55° C. The spreading temperature or temperature range, however, may be any suitable temperature or range of temperatures depending on a number of factors such as the ink formulation, web substrate material, web velocity, and the like.

In order to bring the ink and web temperatures to the spreading temperature or temperature range, the web W is wrapped partially around the leveling roller 104 prior to being fed through the spreading nip 112. In one embodiment, one or both of the leveling roller 104 and the pressure roller 108 are driven in accordance with the web speed by a drive mechanism (not shown), such as a drive motor operably coupled to the roller. Suitable coupling may be through a drive belt, pulley, output shaft, gear or other conventional linkage or coupling mechanism. One or more rollers 26 may also be provided to control the carrying in angle and/or carrying out angle of the web relative to the leveler roller 104.

The leveler roller 104 is a temperature controlled, thermally conductive roller configured to be heated to a predetermined operating temperature that enables the equalization of the ink and web temperatures at the spreading temperature or to within the spreading temperature range. In one embodiment, the leveler roller includes a core formed of a thermally conductive material, such as aluminum, although the core may be made of other suitable materials, such as iron, nickel, stainless steel, and various synthetic resins.

The development of thermal energy in the leveling roller 104 may be accomplished in any suitable manner. For example, the roller core may be hollow and include one or more heating elements 114 disposed therein for generating the required thermal energy in the roller. The heater in the core may comprise a heating lamp such as quartz, carbon filament or halogen lamps. The roll temperature can also be heated or cooled with a fluid flowing through the roller and temperature controlled by an external device. The heater of the leveler roller 104 is configured to heat the roller in accordance with an electrical current provided by one or more heater power supplies (not shown). Although internal heating means have been described for heating the leveler roller, the leveler roller may be heated by external heaters or a combination of internal and external heaters. The heater is controllable to heat the leveler roll 104 to an operating temperature that is capable of equalizing the ink and web temperatures at the spreading temperature prior to the web entering the spreading nip.

Contact between the web and the leveler roller 104 causes conductive heat transference to occur between the web (including the ink thereon) and the leveler roller thereby bringing the temperature of the web and ink toward the operating temperature of the leveling roller, i.e., the spreading temperature. The extent to which the ink and web temperatures may be equalized, or leveled, is generally a function of the temperature of the leveling roller 104, and the length of time, or dwell time, that the web W remains in contact with the leveling roller. As used herein, dwell time refers to the maximum amount of time that any given point on the web remains in contact with the leveler roller. Dwell time between the web and the leveling roller 104 is in turn dependent upon the speed that the web is moving and the wrap length, or contact length, between the web and the leveler roller. The wrap length at which the web W is in contact with the leveling roller 104 may be any suitable wrap length that is capable of creating adequate dwell time to level the ink and web temperatures in light of the web speed and operating temperature of the leveling roller.

Ink and web temperatures exiting the print zone may be in a temperature range of approximately 40° C.-80° C. dependant on the web preheat temperature levels, the proximity of the jetting zone to the spreader (closer=less time to cool) and the number of ink layers (more=hotter). In one embodiment, the leveler roller has a diameter of approximately 10 inches. With about 180 degrees of wrap prior to the spreader nip and at a nominal web speed of 80 ips, the dwell time generated is approximately 195 ms which is capable of bringing the ink and paper temperature close to the target temperature of 55° C. of the leveler roller. In general, the dwell time may be between approximately 100 ms and approximately 300 ms. In alternative embodiments, the dwell time may be configured to only heat the ink and web a minimal distance into the web to achieve spread which allows a shorter dwell time and keeps the ink that would be on the backside of the web during duplex printing at a lower temperature which in turn prevents or reduces ink offsetting to the pressure roll.

With reference to FIG. 2, one or more temperature sensors 116 may be provided for sensing the temperature of the leveling roller 104 and providing appropriate input to a controller 120. Temperature sensors 116 may be any type of temperature sensing device that generates an analog or digital signal indicative of a temperature in the vicinity of the sensor. Such sensors include, for example, thermistors that predictably change in some electrical property, such as resistance, in response to the absorption of heat. The controller 120 is connected to the temperature sensor 116 and to the power sources of the heater 114 of the leveling roller 104. The controller 120 receives signals from the temperature sensor 116 indicative of the temperature of the leveler roller 104 and compares the sensed temperature of the roller to threshold values. Based on the comparison, the controller 120 may adjust the power to the leveler roller heater to maintain the leveler temperature at the desired operating temperature. The controller may be implemented as hardware, software, firmware or any combination thereof. In addition, the controller may be a standalone controller or may be incorporated into the system controller.

In addition, temperature sensors (not shown) may be positioned at various positions upstream or downstream from the temperature leveling ink spreader 100 to insure that the desired ink and web temperatures are reached at various points on the web path. Temperature sensors may be any suitable type of temperature sensing device capable of detecting ink and/or web temperatures. The controller 120 is configured to receive temperature signals from the sensors and may adjust power to the heating elements of the leveling roller in any suitable manner to achieve desired ink and web temperatures.

The leveling roller and pressure nip assembly 100 may also include a cleaning/oiling station 110 associated with the leveling roller 104. Station 110 is suitable for cleaning and/or applying a layer of some lubricant, release oil or other material to the leveling roller surface. For example, station 110 may coat the surface of the leveling roller 104 with a lubricant, such as amino silicone oil, which has a viscosity of about 10-200 centipoises. Following passage through the temperature leveling ink spreader 100, the printed web can be imaged on the other side, and then cut into pages, such as for binding (not shown).

While the embodiments of the temperature leveling ink spreading system 100 are useful in equalizing web and ink temperatures to within a desired range about a target temperature and maintaining the web and ink at the target temperature for a desired amount of time, the leveling roller and pressure nip assembly may be utilized to control the temperature of the web at substantially any point along the web path including prior to, during, and/or after the ink has been deposited thereon.

In addition, although the system 100 has been described in conjunction with a direct-to-media phase change ink imaging device, the leveling roller and pressure nip assembly may be utilized in other types of imaging devices. For example, referring now to FIG. 3, another embodiment of an imaging device, or portion, of an imaging device is shown that utilizes the leveling roller and pressure nip assembly described above. The imaging device of FIG. 3 is a xerographic imaging device that includes a marking system 19 having at least one image forming unit 22 for applying a toner image to a web of substrate (i.e., paper, plastic, or other printable material) received from a media source (not shown).

Figure 3:
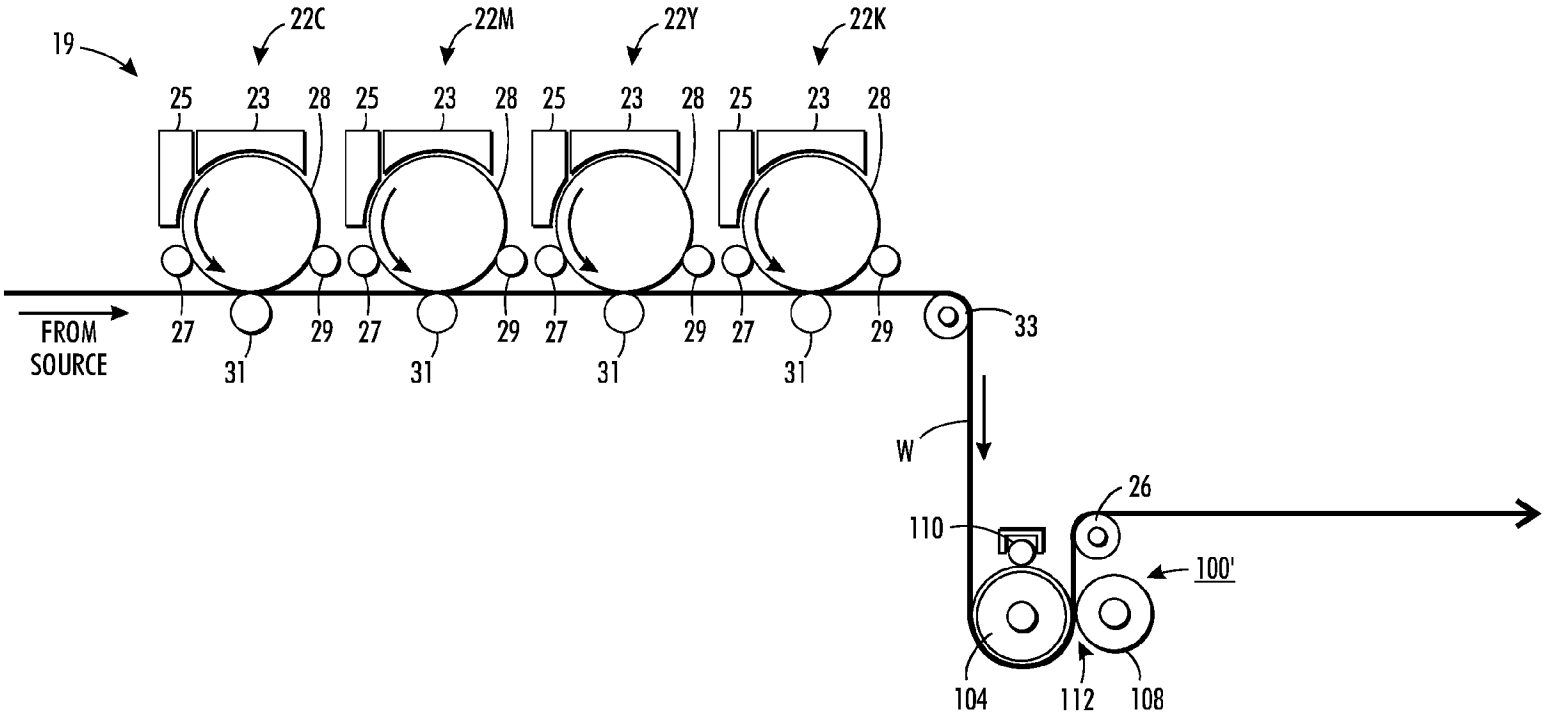
FIG. 3 is a simplified elevational view of a xerographic imaging device which utilizes a temperature leveling roller and pressure nip assembly.

In the embodiment of FIG. 3, the marking system includes four image forming units 22C, 22M, 22Y, and 22K that are each configured to sequentially deposit toner images of different colors, e.g., cyan, magenta, yellow, and black, onto the media web W. In an alternative embodiment, each of four toners cyan, magenta, yellow, and black (CMYK) may be applied to the same photoreceptor and transferred to the media web. In another embodiment, the toner images may each be applied to the same or a separate photoreceptor, and the resulting image transferred to an intermediate transfer belt and then subsequently transferred to the media web.

The image forming units 22C, 22M, 22Y, and 22K have the same configuration except colors of the used toner. Each image forming unit 22C, 22M, 22Y, and 22K includes a photosensitive drum 28, a charging device 23, an exposure device 25, a developing device 27, a transfer device 31 and a drum cleaner 29. The photosensitive drum 28 includes charge retentive surface. The charging device 23 charges the charge retentive surface of the photosensitive drum 28 to a predetermined potential. The exposure device 25 exposes the charged charge retentive surface of the photosensitive drum 28 to form an electrostatic latent image. The developing device 27 receives each color component toner (e.g, in the cyan unit 22C, cyan toner) and develops the electrostatic latent image formed on the charge retentive surface of the photosensitive drum 28 with the toner. The transfer device 31, for example, includes a roller which is in pressure-contact with the photosensitive drum 28 with the media web W disposed therebetween. The transfer device 31 applies a predetermined transfer bias between the photosensitive drum 28 and the transfer roller to transfer the toner image formed on the photosensitive drum 28 onto the media web W. The drum cleaner 29 then removes remaining toner on the photosensitive drum 28 after the transfer. The imaged web W may be discharged outside of the marking system area 19 by means of the transport roller 33.

Following the marking system along the path of the web W is a fixing assembly, referred to in this embodiment as a fusing assembly or fuser. Previously known fusers typically include a heated fuser roller and a pressure roller that define a nip therebetween through which the media web is fed. The heated roller is heated to a fusing temperature that is intended to melt the toner while the pressure in the fusing nip drives the melted toner into the media. Once the media and toner cools down, the toner is adhered or bonded to the media. One difficulty faced in fuser operation is there was little between the media and the fuser or pressure roll other than in the fusing nip. Therefore at high speeds of the media web through the fusing nip, the temperature of the media and image may not reach the appropriate high enough levels. However with the pre-wrap the media and image have more time to achieve fusing temperatures at high speeds In the embodiment of FIG. 3, following the marking system 19 along the path of the web W is a toner fusing system that utilizes a leveling roller and pressure nip assembly 100'. The leveling roller and pressure nip assembly 100' has substantially the same configuration as the system 100 described in relation to FIGS. 2 and 3 except for the operating temperatures and pressures for the system 100' used for fixing or fusing toner particles to media. As mentioned above in relation to FIGS. 2 and 3, the leveling roller and pressure nip assembly includes a temperature controlled leveling roller 104 and a pressure roller 108 that are arranged with respect to each other to define a pressure nip, referred to as a fusing nip 110 in this embodiment, through which the web W is fed. In order to bring the toner and web to the desired fusing temperature or temperature range, the web W is wrapped partially around the leveling roller 104 to generate a predetermined dwell time between the web and leveling roller prior to being fed through the nip 112. The increased dwell time between the web and heated leveling roller, relative to the dwell time in prior fusing systems, enables the temperature of the toner and web to reach the required fusing temperature The fusing nip 110 is configured to apply pressure to the web and the toner on the web to drive the heated toner into the web to promote adherence. The pressure at the fusing nip 110 between the leveling roller and pressure roller may be any suitable pressure. In one practical embodiment, the nip pressure at the fusing nip 110 is set in a range of about 300 psi to about 2500 psi although any suitable fusing nip pressure may be utilized. For optimum fusing performance, toner and web temperatures should be at a target fusing temperature or within a target fusing temperature range that promotes adherence of the toner to the web. In one embodiment, the use of the pre-wrap on the leveler roller enables the fusing temperature to be between approximately 40° C. and approximately 120° C. The fusing temperature or temperature range, however, may be any suitable temperature or range of temperatures depending on a number of factors such as the toner formulation, web substrate material, web velocity, and the like.

Contact between the web and the leveler roller 104, also referred to as dwell time, causes conductive heat transference to occur between the web and the leveler roller to bring the temperature of the toner and web toward the fusing temperature. Dwell time between the web and the leveling roller 104 is dependent upon the speed that the web is moving and the wrap length, or contact length, between the web and the leveler roller. The wrap length at which the web W is in contact with the leveling roller 104 may be any suitable wrap length that is capable of creating adequate dwell time to enable the web and toner temperatures to reach suitable fusing temperatures in the pressure nip. As mentioned above, with a leveler roller diameter of approximately 10 inches and about 180 degrees of wrap around the leveler roller, the dwell time generated is approximately 195 ms which is capable of equilibrating the toner and web temperature at substantially the target fusing temperature.

It will be appreciated that various of the above-disclosed and other features and functions, or alternatives thereof, may be desirably combined into many other different systems, applications or methods. Various presently unforeseen or unanticipated alternatives, modifications, variations or improvements therein may be subsequently made by those skilled in the art which are also intended to be encompassed by the following claims.

What is claimed is:

1. An imaging device comprising:

a substantially continuous web of media;

a web transport system configured to transport the continuous web along a web path in a process direction at a web speed;

a marking system positioned along the web path and configured to apply a marking material to the continuous web to form images on the continuous web;

a leveler roller formed of a thermally conductive material and including a heater configured to generate thermal energy to heat the leveler roller to a target temperature, the leveler roller being positioned to be partially wrapped by a portion of the continuous web to which marking material has been applied to define a wrap length, the wrap length being selected based on the web speed to generate a dwell time during which the portion of the continuous web, the marking material on the portion of the continuous web, and the leveler roller are in contact as the continuous web is being transported to enable conductive heat transfer between the continuous web, the marking material and the leveler roller to occur during the dwell time to bring a temperature of the portion of the continuous web and the marking material on the portion of the continuous web partially wrapped about the leveler roller within a target range about the target temperature; and a pressure roller positioned adjacent the leveler roller to form a pressure nip through which the continuous web is fed after the portion of the continuous web and the marking material on the portion of the continuous web have been in contact with the leveler roller for the predetermined dwell time, the pressure nip applying a target pressure to the continuous web and the marking material on the continuous web in the pressure nip.

2. The imaging device of claim 1, the marking material comprising melted phase change ink.

3. The imaging device of claim 2, the spreading temperature being between approximately 30° C. and approximately 80° C.

4. The imaging device of claim 3, the target temperature being approximately 55° C.

5. The imaging device of claim 2, the target pressure being between approximately 500 psi and approximately 2000 psi.

6. The imaging device of claim 1, the marking material comprising toner.

7. The imaging device of claim 6, the target temperature being between approximately 150° C. and approximately 200° C.

8. The imaging device of claim 6, the target pressure being between 50 psi and 150 psi.

9. A method of operating a continuous feed imaging device, the method comprising:

transporting a substantially continuous web of media along a web path;

depositing marking material onto the continuous web at a marking station positioned along the web path;

wrapping a portion of the continuous web and the marking material on the portion of the continuous web partially around a leveler roller after the deposition of the marking material during a dwell time in which the portion of the continuous web, the marking material on the portion of the continuous web, and the leveler roller are in contact as the continuous web is being transported, the leveler roller being heated to a target temperature, the dwell time being selected with reference to web speed and the target temperature of the leveler roller to enable conductive heat transfer to occur between the portion of the continuous web, the marking material on the portion of the continuous web and the leveler roller during the dwell time to heat the portion of the continuous web and the marking material on the portion of the continuous web to a predetermined range about the target temperature; and feeding the portion of the continuous web and the marking material on the portion of the continuous web after the portion of the continuous web and the marking material on the portion of the continuous web have contacted the leveler roller for the dwell time through a pressure nip formed by the leveler roller and a pressure roller arranged adjacent the leveler roller, the pressure nip being configured to apply a target pressure to the portion of the continuous web and the marking material on the portion of the continuous web.

10. The method of claim 9, the deposition of the marking material onto the web further comprising:

depositing melted phase change ink onto the web.

11. The method of claim 10, the target temperature being between approximately 30° C. and approximately 80° C.

12. The method of claim 11, the target temperature being approximately 55° C.

13. The method of claim 11, the target pressure being between approximately 500 psi and approximately 2000 psi.

14. The method of claim 9, the deposition of the marking material onto the web further comprising:

depositing toner onto the web.

15. The method of claim 14, the target temperature being between approximately 150° C. and approximately 200° C.

16. The method of claim 15, the target pressure being between approximately 50 psi and approximately 150 psi.

17. The imaging device of claim 1 further comprising:

at least one temperature sensor configured to generate a signal indicative of a temperature of the leveler roller; and a controller operatively connected to the at least one temperature sensor and the heater, the controller being configured to adjust electrical power supplied to the heater to bring the portion of the continuous web and the marking material on the portion of the continuous web to a temperature within the predetermined range about the target temperature as the portion of the continuous web and the marking material on the portion of the continuous web enter the pressure nip.

18. The method of claim 9 further comprising:

generating with at least one temperature sensor a signal indicative of a temperature of the leveler roller; and adjusting with a controller electrical power supplied to the heater with reference to the signal from the at least one temperature sensor indicating the temperature of the leveler roller, the electrical power being adjusted to bring the portion of the continuous web and the marking material on the portion of the continuous web to a temperature within the predetermined range about the target temperature prior to the portion of the continuous web and the marking material on the portion of the continuous web entering the pressure nip.

* * * * *